US010684070B2

(12) United States Patent
Turney et al.

(10) Patent No.: US 10,684,070 B2
(45) Date of Patent: Jun. 16, 2020

(54) VARIABLE REFRIGERANT FLOW SYSTEM WITH CAPACITY LIMITS

(71) Applicant: Johnson Controls Technology Company, Auburn Hills, MI (US)

(72) Inventors: Robert D. Turney, Watertown, WI (US); Liming Yang, Mequon, WI (US)

(73) Assignee: Johnson Controls Technology Company, Auburn Hills, MI (US)

( * ) Notice: Subject to any disclaimer, the term of this patent is extended or adjusted under 35 U.S.C. 154(b) by 99 days.

(21) Appl. No.: 16/122,399

(22) Filed: Sep. 5, 2018

(65) Prior Publication Data

US 2020/0072543 A1 Mar. 5, 2020

(51) Int. Cl.

| | |
|---|---|
| ***F24F 1/32*** | (2011.01) |
| ***F24F 11/47*** | (2018.01) |
| ***F25D 29/00*** | (2006.01) |
| ***G06Q 50/06*** | (2012.01) |

(52) U.S. Cl.

CPC ..... *F25D 29/005* (2013.01); *F24F 1/32* (2013.01); *G06Q 50/06* (2013.01); *F25D 2700/04* (2013.01)

(58) Field of Classification Search

CPC ..... F24F 1/32; F24F 11/47; F24F 2120/10; F25D 29/005; F25D 2700/04

See application file for complete search history.

(56) References Cited

U.S. PATENT DOCUMENTS

| | | | | |
|---|---|---|---|---|
| 6,185,483 | B1 * | 2/2001 | Drees | F24F 11/006 700/291 |
| 2007/0125104 | A1 * | 6/2007 | Ehlers | F25D 27/005 62/157 |
| 2013/0085614 | A1 * | 4/2013 | Wenzel | G05D 23/1923 700/277 |
| 2013/0085616 | A1 * | 4/2013 | Wenzel | G05F 1/66 700/278 |
| 2017/0167742 | A1 * | 6/2017 | Radovanovic | G05B 15/02 |
| 2018/0004171 | A1 * | 1/2018 | Patel | F24F 11/30 |
| 2018/0004172 | A1 * | 1/2018 | Patel | F24F 11/54 |
| 2018/0004173 | A1 * | 1/2018 | Patel | F24F 11/62 |
| 2019/0219293 | A1 * | 7/2019 | Wenzel | G06Q 30/0283 |
| 2019/0338977 | A1 * | 11/2019 | Turney | F24F 11/54 |

* cited by examiner

*Primary Examiner* — Marc E Norman

(74) *Attorney, Agent, or Firm* — Foley & Lardner LLP

(57) ABSTRACT

A variable refrigerant flow system includes one or more outdoor units and a first indoor unit of a plurality of indoor units configured to receive refrigerant from the one or more outdoor units. The first indoor unit is configured to serve a first building zone. The variable refrigerant flow system also includes a user input device configured to receive a user command requesting heating or cooling of the first building zone by the first indoor unit. The variable refrigerant flow system also includes a controller configured to receive the command from the user input device, receive an indication of a current price of energy, in response to receiving the command generate a constraint on a capacity of the one or more outdoor units based on the current price of energy, and control the one or more outdoor units to operate in accordance with the constraint.

20 Claims, 3 Drawing Sheets

VARIABLE REFRIGERANT FLOW SYSTEM WITH CAPACITY LIMITS

BACKGROUND

The present disclosure relates generally to the field of variable refrigerant flow (VRF) systems. A VRF system typically includes one or more outdoor VRF units that consume electrical power to heat and/or cool a refrigerant. VRF systems also typically include multiple indoor VRF units located in various spaces of a building, each of which receives the refrigerant from the outdoor VRF unit(s) and uses the refrigerant to transfer heat into or out of a particular space.

In many cases, the various spaces of served by a VRF system may be sporadically and/or irregularly occupied, such that each space is occupied at some points in time and unoccupied at other points in time. It may be desirable to provide heating and/or cooling when a space is occupied to provide for occupant comfort, while turning off heating and/or cooling when the space is unoccupied to reduce energy costs. For example, in some cases indoor VRF units may be controlled by users who turn on the VRF unit when the users enter a space and turn off the indoor VRF unit when the user leaves the space. Accordingly, sporadic building occupancy may create irregular and difficult-to-predict demand on the VRF system.

Some building systems attempt to minimize the utility costs associated with heating and cooling a building based on predictions of future system states. However, the irregular and difficult-to-predict demand on the VRF system caused by sporadic occupation of building zones may substantially reduce the effectiveness of existing approaches to utility cost optimization for building heating and cooling systems. For example, unpredictable occupation of building zones may create spikes in the load on the VRF system that prevent costs from being optimized under existing approaches. Accordingly, a need exists for systems and methods that allow a VRF system to provide comfort to the occupants in sporadically-occupied building zones while also reducing or minimizing utility costs of operating the VRF system.

SUMMARY

One implementation of the present disclosure is a variable refrigerant flow system. The variable refrigerant flow system includes one or more outdoor units and a first indoor unit of a plurality of indoor units configured to receive refrigerant from the one or more outdoor units. The first indoor unit is configured to serve a first building zone. The variable refrigerant flow system also includes a user input device configured to receive a user command requesting heating or cooling of the first building zone by the first indoor unit. The variable refrigerant flow system also includes a controller configured to receive the command from the user input device, receive an indication of a current price of energy, in response to receiving the command generate a constraint on a capacity of the one or more outdoor units based on the current price of energy, and control the one or more outdoor units to operate in accordance with the constraint.

In some embodiments, the controller is configured to remove the constraint after a capacity limit period elapses. In some embodiments, the controller is configured to generate the constraint by multiplying a maximum outdoor unit capacity by a function of the current price of energy to determine a modified constrained capacity. The controller is configured to control the one or more outdoor units by preventing an operating capacity of the one or more outdoor units from exceeding the modified constrained capacity.

In some embodiments, the function is equal to one when the current price of energy is less than a threshold price and equal to a value between zero and one when the current price of energy is greater than the threshold price. In some embodiments, the value is between approximately 0.4 and 0.8.

In some embodiments, the controller is configured to control the one or more outdoor units to operate in accordance with the constraint by optimizing a cost function bound by the constraint. In some embodiments, the controller is configured to remove the constraint after a capacity limit period elapses and optimize the cost function over an optimization period longer than the capacity limit period and comprising the capacity limit period.

Another implementation of the present disclosure is a method of heating or cooling a building. The method includes operating one or more outdoor units to provide refrigerant to a plurality of indoor units. Each indoor unit is associated with a zone of a building. The method also includes receiving an input from a user requesting heating or cooling of a first building zone by a first indoor unit of the plurality of indoor units, receiving an indication of a current price of energy, in response to receiving the input generating a constraint relating to a capacity of the one or more outdoor units based on the current price of energy, and controlling the one or more outdoor units to operate in accordance with the constraint.

In some embodiments, the method includes removing the constraint after a capacity limit period elapses. In some embodiments, generating the constraint includes multiplying a maximum outdoor unit capacity by a function of the current price of energy to determine a modified constrained capacity. Controlling the one or more outdoor units includes preventing an operating capacity of the one or more outdoor units from exceeding the modified constrained capacity.

In some embodiments, the function is equal to one when the current price of energy is less than a threshold price and equal to a value between zero and one when the current price of energy is greater than the threshold price. In some embodiments, the value is between approximately 0.4 and 0.8.

In some embodiments, controlling the one or more outdoor units includes optimizing a cost function bound by the constraint. In some embodiments, the method also includes removing the constraint after a capacity limit period elapses and optimizing the cost function over an optimization period longer than the capacity limit period and comprising the capacity limit period.

Another implementation of the present disclosure is a variable refrigerant flow system. The variable refrigerant flow system includes one or more outdoor units and a first indoor unit of a plurality of indoor units configured to receive refrigerant from the one or more outdoor units. The first indoor unit is configured to serve a first building zone. The variable refrigerant flow system also includes an occupancy detector configured to detect a presence of an occupant in a building zone. The variable refrigerant flow system also includes a control circuit configured to receive an indication from the occupancy detector indicating that the occupant is present in the building zone, receive a current price of energy, in response to receiving the indication generate a constraint relating to a capacity of the one or more outdoor units based on the current price of energy, and control the first indoor unit and the one or more outdoor units to operate in accordance with the constraint and provide heating or cooling to the building zone.

In some embodiments, the controller is configured to remove the constraint after a capacity limit period elapses. In some embodiments, the controller is configured to generate the constraint by multiplying a maximum outdoor unit capacity by a function of the current price of energy to determine a modified constrained capacity. The controller is configured to control the one or more outdoor units by preventing an operating capacity of the one or more outdoor units from exceeding the modified constrained capacity. In some embodiments, the function is equal to one when the current price of energy is less than a threshold price and equal to a value between zero and one when the current price of energy is greater than the threshold price.

In some embodiments, the control circuit is configured to control the one or more outdoor units to operate in accordance with the constraint by optimizing a cost function bound by the constraint. In some embodiments, the control circuit is configured to remove the constraint after a capacity limit period elapses and optimize the cost function over an optimization period longer than the capacity limit period and comprising the capacity limit period.

DETAILED DESCRIPTION

Variable Refrigerant Flow Systems

Figure 1A:
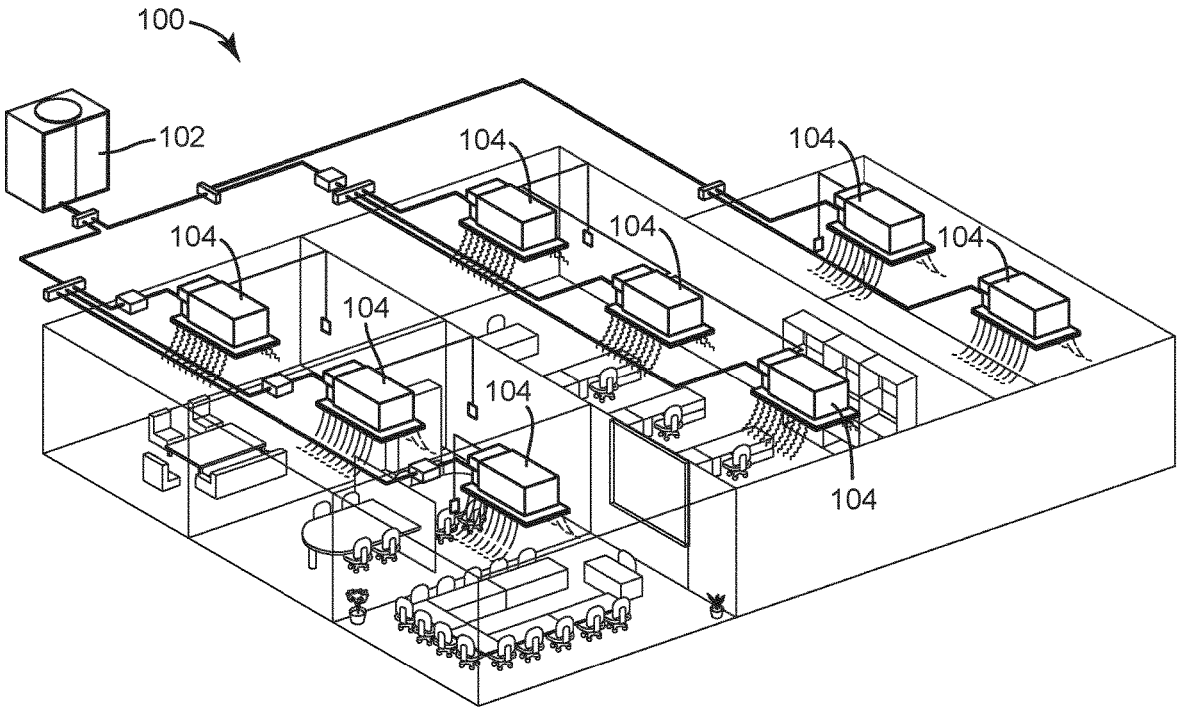
FIG. 1A is a first illustration of a variable refrigerant flow system for a building, according to some embodiments.
Figure 1B:
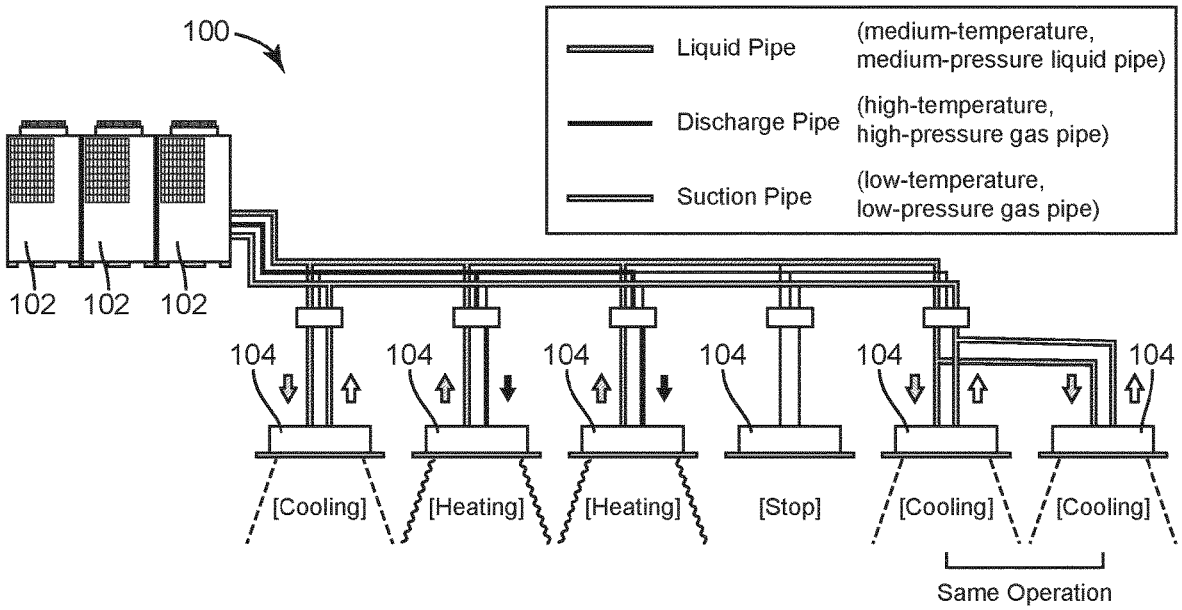
FIG. 1B is a second illustration of a variable refrigerant flow system for a building, according to some embodiments.

Referring now to FIGS. 1A-B, a variable refrigerant flow (VRF) system 100 is shown, according to some embodiments. VRF system 100 is shown to include one or more outdoor VRF units 102 and a plurality of indoor VRF units 104. Outdoor VRF units 102 can be located outside a building and can operate to heat or cool a refrigerant. Outdoor VRF units 102 can consume electricity to convert refrigerant between liquid, gas, and/or super-heated gas phases. Indoor VRF units 104 can be distributed throughout various building zones within a building and can receive the heated or cooled refrigerant from outdoor VRF units 102. Each indoor VRF unit 104 can provide temperature control for the particular building zone in which the indoor VRF unit 104 is located. Although the term "indoor" is used to denote that the indoor VRF units 104 are typically located inside of buildings, in some cases one or more indoor VRF units are located "outdoors" (i.e., outside of a building) for example to heat/cool a patio, entryway, walkway, etc.

One advantage of VRF system 100 is that some indoor VRF units 104 can operate in a cooling mode while other indoor VRF units 104 operate in a heating mode. For example, each of outdoor VRF units 102 and indoor VRF units 104 can operate in a heating mode, a cooling mode, or an off mode. Each building zone can be controlled independently and can have different temperature setpoints. In some embodiments, each building has up to three outdoor VRF units 102 located outside the building (e.g., on a rooftop) and up to 128 indoor VRF units 104 distributed throughout the building (e.g., in various building zones). Building zones may include, among other possibilities, apartment units, offices, retail spaces, and common areas. In some cases, various building zones are owned, leased, or otherwise occupied by a variety of tenants, all served by the VRF system 100.

Many different configurations exist for VRF system 100. In some embodiments, VRF system 100 is a two-pipe system in which each outdoor VRF unit 102 connects to a single refrigerant return line and a single refrigerant outlet line. In a two-pipe system, all of outdoor VRF units 102 may operate in the same mode since only one of a heated or chilled refrigerant can be provided via the single refrigerant outlet line. In other embodiments, VRF system 100 is a three-pipe system in which each outdoor VRF unit 102 connects to a refrigerant return line, a hot refrigerant outlet line, and a cold refrigerant outlet line. In a three-pipe system, both heating and cooling can be provided simultaneously via the dual refrigerant outlet lines. An example of a three-pipe VRF system is described in detail with reference to FIG. 2.

Figure 2:
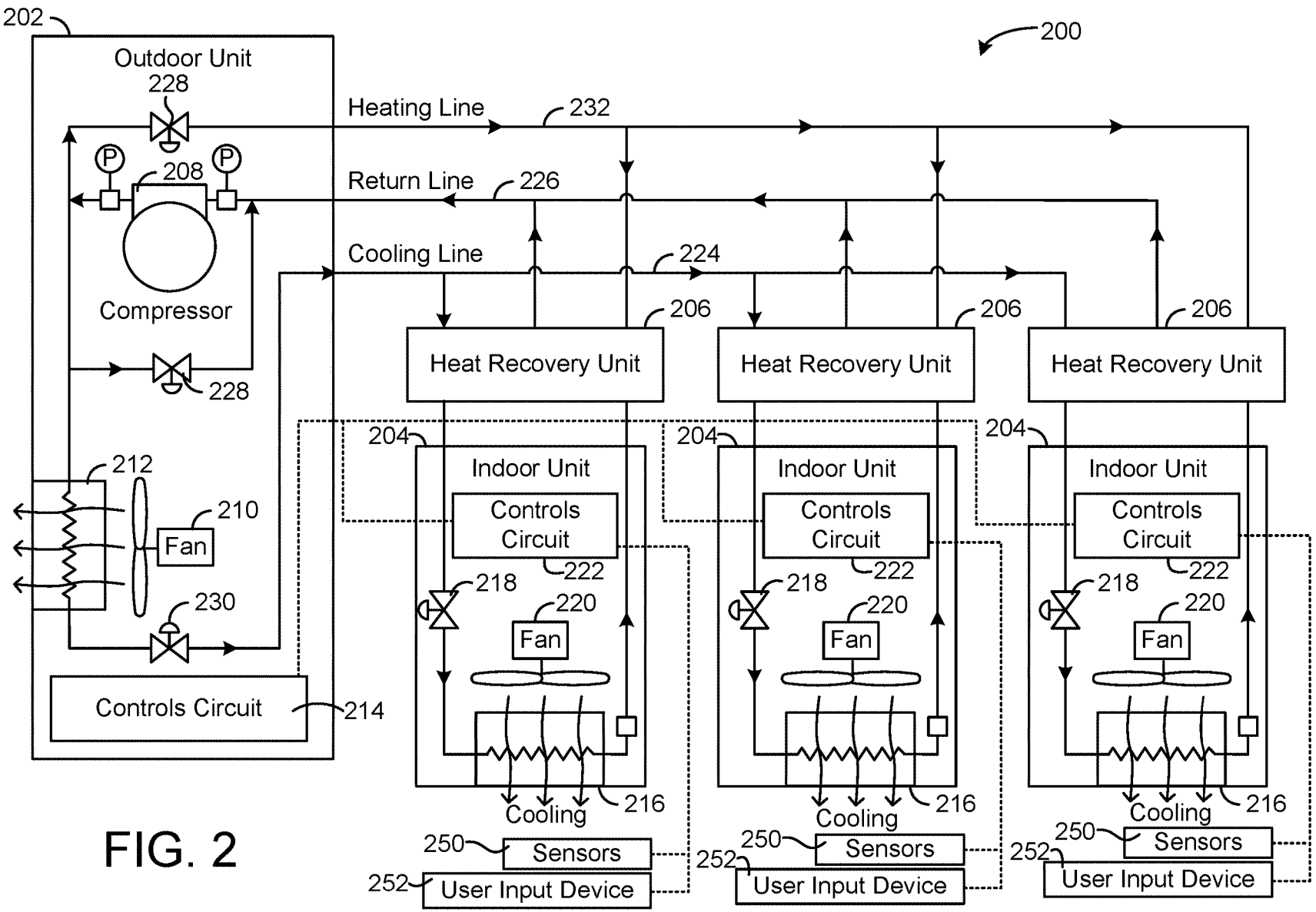
FIG. 2 is a detailed diagram of a variable refrigerant flow system for a building, according to some embodiments.

Referring now to FIG. 2, a block diagram illustrating a VRF system 200 is shown, according to some embodiments. VRF system 200 is shown to include outdoor VRF unit 202, several heat recovery units 206, and several indoor VRF units 204. Although FIG. 2 shows one outdoor VRF unit 202, embodiments including multiple outdoor VRF units 202 are also within the scope of the present disclosure. Outdoor VRF unit 202 may include a compressor 208, a fan 210, or other power-consuming refrigeration components configured convert a refrigerant between liquid, gas, and/or super-heated gas phases. Indoor VRF units 204 can be distributed throughout various building zones within a building and can receive the heated or cooled refrigerant from outdoor VRF unit 202. Each indoor VRF unit 204 can provide temperature control for the particular building zone in which the indoor VRF unit 204 is located. Heat recovery units 206 can control the flow of a refrigerant between outdoor VRF unit 202 and indoor VRF units 204 (e.g., by opening or closing valves) and can minimize the heating or cooling load to be served by outdoor VRF unit 202.

Outdoor VRF unit 202 is shown to include a compressor 208 and a heat exchanger 212. Compressor 208 circulates a refrigerant between heat exchanger 212 and indoor VRF units 204. The compressor 208 operates at a variable frequency as controlled by outdoor unit controls circuit 214. At higher frequencies, the compressor 208 provides the indoor VRF units 204 with greater heat transfer capacity. Electrical power consumption of compressor 208 increases proportionally with compressor frequency.

Heat exchanger 212 can function as a condenser (allowing the refrigerant to reject heat to the outside air) when VRF system 200 operates in a cooling mode or as an evaporator (allowing the refrigerant to absorb heat from the outside air) when VRF system 200 operates in a heating mode. Fan 210 provides airflow through heat exchanger 212. The speed of fan 210 can be adjusted (e.g., by outdoor unit controls circuit 214) to modulate the rate of heat transfer into or out of the refrigerant in heat exchanger 212.

Each indoor VRF unit 204 is shown to include a heat exchanger 216 and an expansion valve 218. Each of heat exchangers 216 can function as a condenser (allowing the refrigerant to reject heat to the air within the room or zone) when the indoor VRF unit 204 operates in a heating mode or as an evaporator (allowing the refrigerant to absorb heat from the air within the room or zone) when the indoor VRF unit 204 operates in a cooling mode. Fans 220 provide airflow through heat exchangers 216. The speeds of fans 220 can be adjusted (e.g., by indoor unit controls circuits 222) to modulate the rate of heat transfer into or out of the refrigerant in heat exchangers 216.

In FIG. 2, indoor VRF units 204 are shown operating in the cooling mode. In the cooling mode, the refrigerant is provided to indoor VRF units 204 via cooling line 224. The refrigerant is expanded by expansion valves 218 to a cold, low pressure state and flows through heat exchangers 216 (functioning as evaporators) to absorb heat from the room or zone within the building. The heated refrigerant then flows back to outdoor VRF unit 202 via return line 226 and is compressed by compressor 208 to a hot, high pressure state. The compressed refrigerant flows through heat exchanger 212 (functioning as a condenser) and rejects heat to the outside air. The cooled refrigerant can then be provided back to indoor VRF units 204 via cooling line 224. In the cooling mode, flow control valves 228 can be closed and expansion valve 230 can be completely open.

In the heating mode, the refrigerant is provided to indoor VRF units 204 in a hot state via heating line 232. The hot refrigerant flows through heat exchangers 216 (functioning as condensers) and rejects heat to the air within the room or zone of the building. The refrigerant then flows back to outdoor VRF unit via cooling line 224 (opposite the flow direction shown in FIG. 2). The refrigerant can be expanded by expansion valve 230 to a colder, lower pressure state. The expanded refrigerant flows through heat exchanger 212 (functioning as an evaporator) and absorbs heat from the outside air. The heated refrigerant can be compressed by compressor 208 and provided back to indoor VRF units 204 via heating line 232 in a hot, compressed state. In the heating mode, flow control valves 228 can be completely open to allow the refrigerant from compressor 208 to flow into heating line 232.

As shown in FIG. 2, each indoor VRF unit 204 includes an indoor unit controls circuit 222. Indoor unit controls circuit 222 controls the operation of components of the indoor VRF unit 204, including the fan 220 and the expansion valve 218, in response to a building zone temperature setpoint or other request to provide heating/cooling to the building zone. The indoor unit controls circuit 222 may also determine a heat transfer capacity required by the indoor VRF unit 204 and transmit a request to the outdoor VRF unit 202 requesting that the outdoor VRF unit 202 operate at a corresponding capacity to provide heated/cooled refrigerant to the indoor VRF unit 204 to allow the indoor VRF unit 204 to provide a desired level of heating/cooling to the building zone.

Each indoor unit controls circuit 222 is shown as communicably coupled to one or more sensors 250 and a user input device 252. In some embodiments, the one or more sensors 250 may include a temperature sensor (e.g., measuring indoor air temperature), a humidity sensor, and/or a sensor measuring some other environmental condition of a building zone served by the indoor VRF unit 204. In some embodiments, the one or more sensors include an occupancy detector configured to detect the presence of one or more people in the building zone and provide an indication of the occupancy of the building zone to the indoor unit controls circuit 222.

Each user input device 252 may be located in the building zone served by a corresponding indoor unit 204. The user input device 252 allows a user to input a request to the VRF system 200 for heating or cooling for the building zone and/or a request for the VRF system 200 to stop heating/cooling the building zone. According to various embodiments, the user input device 252 may include a switch, button, set of buttons, thermostat, touchscreen display, etc. The user input device 252 thereby allows a user to control the VRF system 200 to receive heating/cooling when desired by the user.

The indoor unit controls circuit 222 may thereby receive an indication of the occupancy of a building zone (e.g., from an occupancy detector of sensors 250 and/or an input of a user via user input device 252). In response, the indoor unit controls circuit 222 may generate a new request for the outdoor VRF unit 202 to operate at a requested operating capacity to provide refrigerant to the indoor unit 204. The indoor unit controls circuit 222 may also receive an indication that the building zone is unoccupied and, in response, generate a signal instructing the outdoor VRF unit 202 to stop operating at the requested capacity. The indoor unit controls circuit 222 may also control various components of the indoor unit 204, for example by generating a signal to turn the fan 220 on and off.

The outdoor unit controls circuit 214 may receive heating/cooling capacity requests from one or more indoor unit controls circuits 222 and aggregate the requests to determine a total requested operating capacity. Accordingly, the total requested operating capacity may be influenced by the occupancy of each of the various building zones served by various indoor units 204. In many cases, a when a person or people first enter a building zone and a heating/cooling request for that zone is triggered, the total requested operating capacity may increase significantly, for example reaching a maximum operating capacity. Thus, the total request operating capacity may vary irregularly and unpredictably as a result of the sporadic occupation of various building zones.

The outdoor unit controls circuit 214 is configured to control the compressor 208 and various other elements of the outdoor unit 202 to operate at an operating capacity based at least in part on the total requested operating capacity. At higher operating capacities, the outdoor unit 202 consumes more power, which increases utility costs.

For an operator, owner, lessee, etc. of a VRF system, it may be desirable to minimize power consumption and utility costs to save money, improve environmental sustainability, reduce wear-and-tear on equipment, etc. In some cases multiple entities or people benefit from reduced utility costs, for example according to various cost apportionment schemes for VRF systems described in U.S. patent application Ser. No. 15/920,077 filed Mar. 13, 2018, incorporated by reference herein in its entirety. Thus, as described in detail below, the controls circuit 214 may be configured to manage the operating capacity of the outdoor VRF unit 202 to reduce utility costs while also providing comfort to building occupants. Accordingly, in some embodiments, the controls circuit 214 may be operable in concert with systems and methods described in P.C.T. Patent Application No. PCT/US2017/039,937 filed Jun. 29, 2017, and/or U.S. patent application Ser. No. 15/635,754 filed Jun. 28, 2017, both of which are incorporated by reference herein in their entireties.

Outdoor Unit Controls Circuit with Capacity Constraints

Figure 3:
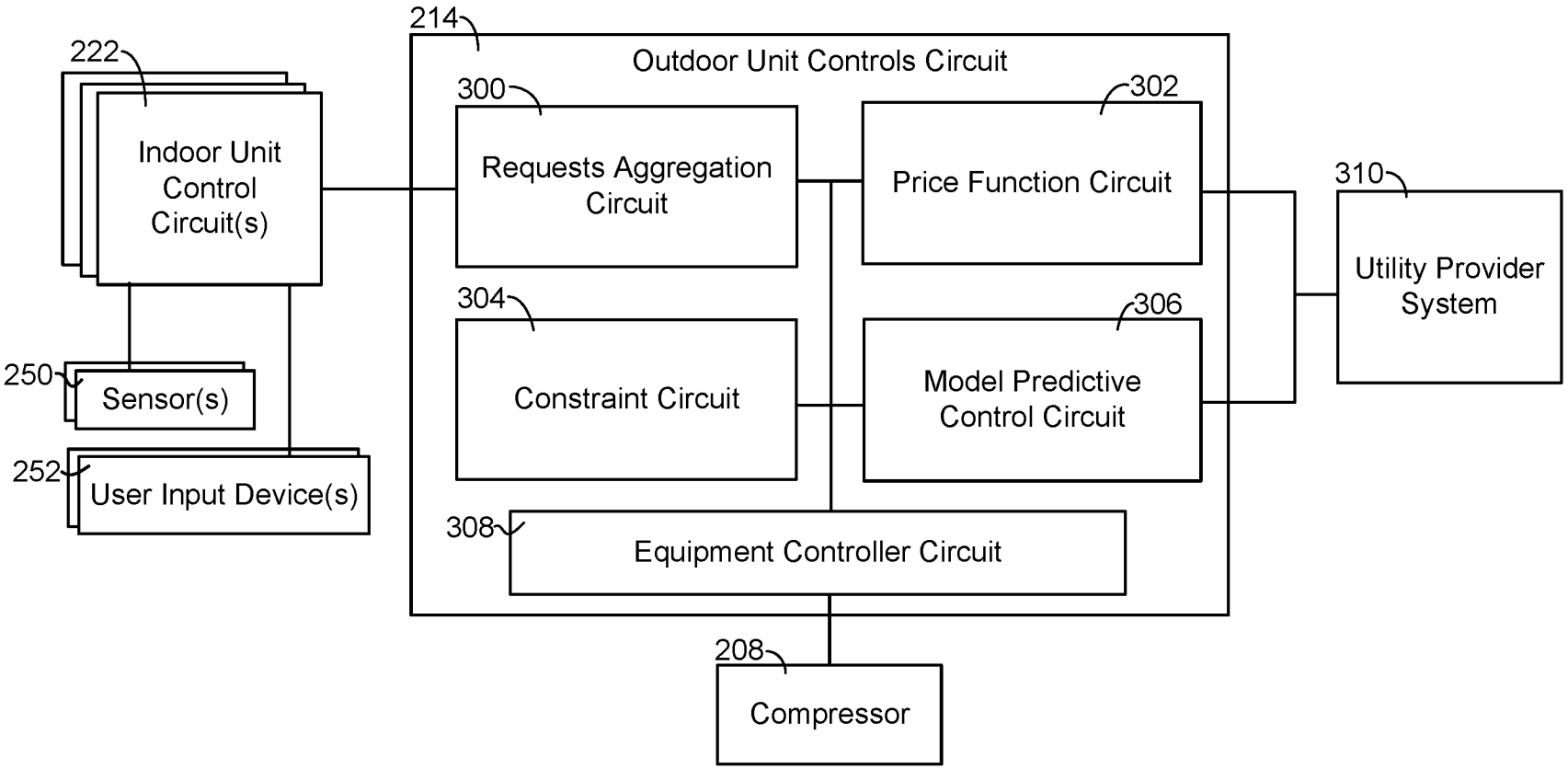
FIG. 3 is a block diagram of a controller for use with the variable refrigerant flow systems of FIGS. 1-2, according to some embodiments.

Referring now to FIG. 3, a detailed block diagram of the outdoor unit controls circuit 214 is shown, according to an exemplary embodiment. As described in detail below, the outdoor unit controls circuit 214 is configured to receive heating/cooling requests from one or more indoor unit controls circuits 222, receive a current utility price, determine a value of a price function based on the utility price, generate a capacity constraint based on the price function, apply the constraint in an optimization problem in an economic model predictive control approach, and control the outdoor VRF unit 202 to conform to the constraint based on a solution to the optimization problem. It should be understood that while the following discussion refers to controlling one outdoor VRF unit 202 for the sake of clarity of explanation, the present disclosure also contemplates systems and methods for controlling multiple outdoor VRF units 202.

As shown in FIG. 3, the outdoor unit controls circuit 214 includes a requests aggregation circuit 300, a price function circuit 302, a constraint circuit 304, and a model predictive control circuit 306. The outdoor unit controls circuit 214 is shown as communicable with a utility provider system 310, the compressor 208 of the outdoor VRF unit 202, one or more indoor unit controls circuits 222, and sensor(s) 250 and/or user input device(s) 252 located in the various building zones served by the various indoor VRF units 204. The outdoor unit controls circuit 214 may also be communicable coupled to various other components of the outdoor VRF unit 202, including fan 210, flow control valves 228, and expansion valve 230.

The utility provider system 310 is associated with a utility provider of energy or power (e.g., electrical power) to the VRF system 200. The utility provider sets the price of the power. For example, the utility provider may use a pricing scheme where the unit price of power (e.g., dollars per kilowatt-hour) varies over time, for example creating high price periods and low price periods. The utility provider system 310 is configured to provide the current price of the power to the outdoor unit controls circuit 214. In some embodiments, the VRF system 200 consumes power from various utility providers and/or power stored and/or generated by an energy storage system and/or central plant associated with the VRF system 200, in which case the outdoor unit controls circuit 214 may be configured to determine a current price of power based on the costs associated with the various available energy sources.

The requests aggregation circuit 300 can receive one or more capacity requests from the one or more indoor unit control circuit(s) 222. A capacity request may be generated by an indoor unit controls circuit 222 in response to a user input to a user input device 252 and/or detection of occupation of a building zone by one or more sensors 250. The requests aggregation circuit 300 may combine, sum, total, etc. the one or more capacity requests to determine a total requested capacity. In response to receiving a new capacity request from an indoor unit controls circuit 222, the requests aggregation circuit 300 may update the total requested capacity. If the new capacity request represents a new request of increased heating/cooling for a building zone, the requests aggregation circuit 300 provides an indication of the new request to the price function circuit 302.

The price function circuit 302 is configured to receive a current price of power from a utility provider system 310 and, in response to indication of a new request for heating/cooling, calculate a value of a price function based on the current price of power. That is, the price function circuit 302 calculates a value of f(Price) where Price is the current price of power. The function f(Price) may be predefined and may have various formulations according to various embodiments. In some embodiments, the possible values of f(Price) range from zero to one, with the value of f(Price) lower when Price is higher. In some embodiments f(Price) is a step function, such that the value of f(Price) is one when Price is less than a threshold price and less than one when Price is greater than a threshold price, for example a value between 0.4 and 0.8. As one example, in some embodiments:

$$f(\text{Price}) = \begin{cases} 0.6, & \frac{\text{price upper limit}}{2} < \text{Price} \leq \text{price upper limit} \\ 1, & \text{otherwise} \end{cases},$$

where price upper limit is a maximum price of power charged by the utility provider. Thus, in some embodiments, f(Price) as calculated by the price function circuit 302 has a fractional value in high-priced periods and a value of one in low-priced periods. The price function circuit 302 provides the current value of the price function to the constraint circuit 304.

The constraint circuit 304 is configured to generate a constraint on the operating capacity of the compressor 208 based on the value of the price function provided by the price function circuit 302. The constraint circuit 304 may formulate the constraint to be applied in a model predictive control approach for each time step k up to a prediction horizon Horizon. Accordingly, the constraint circuit 304 may generate a constraint of the form:

$$\chi_{ODU,k} \geq 0,\ \forall k \in \text{Horizon};$$

$$\chi_{ODU,k} \leq \text{cap}_{ODU,k} * \text{PriceFactor}_k,\ \forall k \in \text{Horizon},$$

where $\chi_{ODU,k}$ is the operating capacity of the outdoor VRF unit 202, $\text{cap}_{ODU,k}$ is the maximum capacity of the outdoor VRF unit 202 (i.e., the physical upper limit on the operating capacity of the outdoor VRF unit 202), and $\text{PriceFactor}_k$ is a function of f(Price). For example, the constraint circuit 304 may determine a value of $\text{PriceFactor}_k$ as:

$$PriceFactor_k = \begin{cases} f(\text{Price}), & t_0 < k < t_{0+Capacity\ Limit\ Period} \\ 1, & \forall \text{ other } k \in \text{Horizon} \end{cases},$$

where $t_0$ denotes the time of a new request for heating/cooling from an indoor unit controls circuit 222 (e.g., a time step when a sensor 250 detects new occupancy of a zone or a user inputs request to a user input device 252 requesting heating/cooling) and Capacity Limit Period is a number of time steps for which a modified capacity constraint will be applied following the time of the new request $t_0$. The capacity limit period may be shorter than the time horizon, such that $t_0$+Capacity Limit Period∈Horizon.

Accordingly, in such an embodiment, the constraint circuit 304 generates a modified capacity constraint of $\chi_{ODU,k} \leq \text{cap}_{ODU,k}$*f(Price) for a capacity limit period following a new request for increased operating capacity of the outdoor VRF unit 202. The term $\text{cap}_{ODU,k}$*f(Price) may be referred to as the modified constrained capacity. Because in a high priced period the value of f(Price) is less than one, the constraint circuit 304 thereby limits the operating capacity of the outdoor VRF unit 202 in response to a new request for heating/cooling of a building zone based on occupancy of the building zone. In other words, the constraint circuit 304 generates a constraint that prevents the outdoor VRF unit 202 from being driven to a maximum operating capacity when an indoor VRF system 204 is turned on for a building zone during a period of high utility prices. Accordingly, the constraint circuit 304 may facilitate reduction of utility costs by reducing power consumption of the outdoor VRF unit 202 during high-priced periods.

The constraint circuit 304 provides the capacity constraint to the model predictive control circuit 306. The model predictive control circuit 306 applies the capacity constraint to an optimization problem and solves the optimization problem over the time horizon, i.e., for time steps k∈Horizon. The model predictive control circuit 306 may generate the optimization problem based on a predictive model or models of the system (e.g., a building thermal model, a VRF equipment model, a load predictor, a disturbance estimation) and various system constraints. In some embodiments, the model predictive control circuit 306 generates and solves the optimization problem by defining a cost function and minimizing the cost function over the time horizon. For example, the model predictive control circuit 306 may define a cost function of the form:

$$J=\Sigma_{k=1}^{Horizon}[(\text{EnergyCosts}(k))+(\text{Penalties}(k))]+(\text{Demand Charges}),$$

where the Penalties(k) penalize deviation from comfortable environmental conditions in the building for occupants, for example as described in U.S. Provisional Patent Application No. 62/667,979 filed May 7, 2018, incorporated by reference herein in its entirety.

In the embodiment shown, the model predictive control circuit 306 solves the optimization problem bound by the capacity constraint generated by the constraint circuit 304 to determine an operating capacity for the outdoor VRF unit 202 for each time step in the time horizon. The model predictive control circuit 306 provides the operating capacities for the time horizon to the equipment controller circuit 308. The equipment controller circuit 308 generates control signals for the compressor 208 and/or other elements of the outdoor VRF unit 202 based on the operating capacities provided by the model predictive control circuit 306. For example, the equipment controller circuit 308 may control the compressor frequency of the compressor 208 to cause the compressor 208 to operate at the desired operating capacity for the current time step. The equipment controller circuit 308 may also generate control signals to control the one or more indoor VRF units 204 based on the operating capacity for a time step provided by the model predictive control circuit 306. The outdoor unit controls circuit 214 thereby controls the outdoor VRF unit 202 to conform to the modified capacity constraint, i.e., to prevent the operating capacity of the outdoor VRF unit 202 from exceeding the modified constrained capacity.

Configuration of Exemplary Embodiments

Although the figures show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, calculation steps, processing steps, comparison steps, and decision steps.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

As used herein, the term "circuit" may include hardware structured to execute the functions described herein. In some embodiments, each respective "circuit" may include machine-readable media for configuring the hardware to execute the functions described herein. The circuit may be embodied as one or more circuitry components including, but not limited to, processing circuitry, network interfaces, peripheral devices, input devices, output devices, sensors, etc. In some embodiments, a circuit may take the form of one or more analog circuits, electronic circuits (e.g., integrated circuits (IC), discrete circuits, system on a chip (SOCs) circuits, etc.), telecommunication circuits, hybrid circuits, and any other type of "circuit." In this regard, the "circuit" may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on).

The "circuit" may also include one or more processors communicably coupled to one or more memory or memory devices. In this regard, the one or more processors may execute instructions stored in the memory or may execute instructions otherwise accessible to the one or more processors. In some embodiments, the one or more processors may be embodied in various ways. The one or more processors may be constructed in a manner sufficient to perform at least the operations described herein. In some embodiments, the one or more processors may be shared by multiple circuits (e.g., circuit A and circuit B may comprise or otherwise share the same processor which, in some example embodiments, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multithreaded instruction execution. Each processor may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor, etc.), microprocessor, etc. In some embodiments, the one or more processors may be external to the apparatus, for example the one or more processors may be a remote processor (e.g., a cloud based processor). Alternatively or additionally, the one or more processors may be internal and/or local to the apparatus. In this regard, a given circuit or components thereof may be disposed locally (e.g., as part of a local server, a local computing system, etc.) or remotely (e.g., as part of a remote server such as a cloud based server). To that end, a "circuit" as described herein may include components that are distributed across one or more locations. The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

What is claimed is:

1. A variable refrigerant flow system, comprising:

one or more outdoor units;

a first indoor unit of a plurality of indoor units configured to receive refrigerant from the one or more outdoor units, the first indoor unit configured to serve a first building zone;

a user input device configured to receive a user command requesting heating or cooling of the first building zone by the first indoor unit; and a controller configured to:

receive the command from the user input device;

receive an indication of a current price of energy;

in response to receiving the command, generate a constraint on a capacity of the one or more outdoor units based on the current price of energy; and control the one or more outdoor units to operate in accordance with the constraint.

2. The variable refrigerant flow system of claim 1, wherein the controller is configured to remove the constraint after a capacity limit period elapses.

3. The variable refrigerant flow system of claim 1, wherein:

the controller is configured to generate the constraint by multiplying a maximum outdoor unit capacity by a function of the current price of energy to determine a modified constrained capacity; and the controller is configured to control the one or more outdoor units by preventing an operating capacity of the one or more outdoor units from exceeding the modified constrained capacity.

4. The variable refrigerant flow system of claim 3, wherein the function is equal to one when the current price of energy is less than a threshold price and equal to a value between zero and one when the current price of energy is greater than the threshold price.

5. The variable refrigerant flow system of claim 4, wherein the value is between approximately 0.4 and 0.8.

6. The variable refrigerant flow system of claim 1, wherein the controller is configured to control the one or more outdoor units to operate in accordance with the constraint by optimizing a cost function bound by the constraint.

7. The variable refrigerant flow system of claim 6, wherein the controller is configured to:

remove the constraint after a capacity limit period elapses; and optimize the cost function over an optimization period longer than the capacity limit period and comprising the capacity limit period.

8. A method of heating or cooling a building, comprising:

operating one or more outdoor units to provide refrigerant to a plurality of indoor units, each indoor unit associated with a zone of a building;

receiving an input from a user requesting heating or cooling of a first building zone by a first indoor unit of the plurality of indoor units;

receiving an indication of a current price of energy;

in response to receiving the input, generating a constraint relating to a capacity of the one or more outdoor units based on the current price of energy; and controlling the one or more outdoor units to operate in accordance with the constraint.

9. The method of claim 8, further comprising removing the constraint after a capacity limit period elapses.

10. The method of claim 8, wherein:

generating the constraint comprises multiplying a maximum outdoor unit capacity by a function of the current price of energy to determine a modified constrained capacity; and controlling the one or more outdoor units comprises preventing an operating capacity of the one or more outdoor units from exceeding the modified constrained capacity.

11. The method of claim 10, wherein the function is equal to one when the current price of energy is less than a threshold price and equal to a value between zero and one when the current price of energy is greater than the threshold price.

12. The method of claim 11, wherein the value is between approximately 0.4 and 0.8.

13. The method of claim 8, wherein controlling the one or more outdoor units comprises optimizing a cost function bound by the constraint.

14. The method of claim 13, furthering comprising:

removing the constraint after a capacity limit period elapses; and optimizing the cost function over an optimization period longer than the capacity limit period and comprising the capacity limit period.

15. A variable refrigerant flow system, comprising:

one or more outdoor units;

a first indoor unit of a plurality of indoor units configured to receive refrigerant from the one or more outdoor units, the first indoor unit serving a first building zone;

an occupancy detector configured to detect a presence of an occupant in a building zone; and a control circuit configured to:

receive an indication from the occupancy detector indicating that the occupant is present in the building zone;

receive a current price of energy;

in response to receiving the indication, generate a constraint relating to a capacity of the one or more outdoor units based on the current price of energy; and control the first indoor unit and the one or more outdoor units to operate in accordance with the constraint and provide heating or cooling to the building zone.

16. The variable refrigerant flow system of claim 15, wherein the control circuit is configured to remove the constraint after a capacity limit period elapses.

17. The variable refrigerant flow system of claim 15, wherein:

the control circuit is configured to generate the constraint by multiplying a maximum outdoor unit capacity by a function of the current price of energy to determine a modified constrained capacity; and the control circuit is configured to control the one or more outdoor units by preventing an operating capacity of the one or more outdoor units from exceeding the modified constrained capacity.

18. The variable refrigerant flow system of claim 17, wherein the function is equal to one when the current price of energy is less than a threshold price and equal to a value between zero and one when the current price of energy is greater than the threshold price.

19. The variable refrigerant flow system of claim 15, wherein the control circuit is configured to control the one or more outdoor units to operate in accordance with the constraint by optimizing a cost function bound by the constraint.

20. The variable refrigerant flow system of claim 19, wherein the control circuit is configured to:

remove the constraint after a capacity limit period elapses; and optimize the cost function over an optimization period longer than the capacity limit period and comprising the capacity limit period.

* * * * *